US006769591B2

(12) United States Patent
Yamamoto et al.

(10) Patent No.: US 6,769,591 B2
(45) Date of Patent: Aug. 3, 2004

(54) NAILING MACHINE

(75) Inventors: Hiroki Yamamoto, Tokyo (JP); Tatsusi Ogawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/458,263

(22) Filed: Jun. 11, 2003

(65) Prior Publication Data

US 2003/0230621 A1 Dec. 18, 2003

(30) Foreign Application Priority Data

Jun. 17, 2002 (JP) ..... P. 2002-176072

(51) Int. Cl.[7] ..... B25C 1/04
(52) U.S. Cl. ..... 227/113; 227/119
(58) Field of Search ..... 227/113, 119, 227/120, 136

(56) References Cited

U.S. PATENT DOCUMENTS 4,049,181 A * 9/1977 Kametaki ..... 227/113
4,463,888 A * 8/1984 Geist et al. ..... 227/119
5,904,285 A * 5/1999 Anderson ..... 227/115
6,308,879 B1 * 10/2001 Wang ..... 227/113
6,430,800 B1 * 8/2002 Buck ..... 29/430
6,443,348 B2 * 9/2002 Lamb ..... 227/136

* cited by examiner

*Primary Examiner*—Scott A. Smith
(74) *Attorney, Agent, or Firm*—Morgan, Lewis & Bockius LLP

(57) ABSTRACT

In a nailing machine in which a linear-sheath-shaped magazine for storing therein connected nails connected together in a linear manner is disposed so as to be continuous with a nose part, the connected nails are supplied from the magazine to an injection port formed in the nose part, and the connected nails are then driven out of the injection port by a driver, a magnet is disposed on a supply guide surface which is used to guide the nails from the magazine to the injection port of the nose part, and such portion of the shaft of the nail as ranges from the longitudinal-direction center of the nail shaft portion to the leading end side portion thereof is attracted and held by the magnet to thereby be able to prevent the leading end side portion of the shaft portion of the nail left in the injection port from entering into the magazine.

8 Claims, 9 Drawing Sheets

NAILING MACHINE

BACKGROUND OF THE INVENTION

The present invention relates to a nailing machine with a nail inclining preventive mechanism in which linear-shaped connected nails with their nail shaft portions connected together by a plastic member or a piece of paper are loaded into a magazine formed in a linear sheath shape, the thus-loaded connected nails within the magazine are sequentially pressed and supplied into an injection port which guides a driver to be driven by compressed air in such a manner that the driver can be slid, and the top nail of the connected nails supplied into the injection port is driven out of the injection port by the driver.

In the case of a nailing machine that can be operated or driven using compressed air as a drive source, in the interior of the nailing machine, there is disposed a cylinder which stores therein a piston integrally combined with a driver for driving nails. Downwardly of the cylinder, there is formed a nose part which is used to guide the driver connected with the piston in a slidable manner, while the driver is stored in an injection port formed in the nose part and is slidably guided. A magazine, which is formed in a linear sheath shape and also into which connected nails composed of a large number of nails connected together in parallel can be loaded, is disposed backwardly of and continuously with the nose part, and the connected nails loaded into the magazine are pressed and energized from the tail end of the connected nails, whereby the top nail of the connected nails can be supplied into the injection port of the nose part.

In a conventional nailing machine, as shown in FIG. 9, in a nose part 30, there is formed an opening which is used to introduce connected nails N loaded into a magazine 31 into an injection port 32 formed in the nose part 30, and the top nail N of the connected nails N pressed and energized from the rear end direction thereof by a pusher 34 within the magazine 31 is supplied from the opening 33 into the injection port 32. By the way, the operation to load the connected nails N into the magazine 31 is executed in the following manner: that is, the pusher 34 is slid and moved in the rear end direction of the magazine 31, new connected nails N are loaded into the rear portion of the linear-sheath-shaped magazine 31 and, after then, the pusher 34 is pressed against the rear end portion of the newly loaded connected nails N to thereby energize the same.

In a normal case, after the connected nails N loaded into the magazine 31 are all driven out from there, that is, when the magazine 31 is empty, the above-mentioned loading operation of the new connected nails N is executed. However, according to cases, new connected nails N can be replenished and loaded in a state where some of the previously loaded connected nails are left in the magazine, or new connected nails N can be loaded due to the wrong judgment that no nail is present in the magazine 31. As a result of this, the loading operation of the connected nails into the magazine 31 is carried out at an arbitrary time regardless of the number of nails which are left in the magazine 31. In case where the nails loading operation is carried out in a state in which only one nail N is left in the magazine 31, depending on the direction of the nailing machine in the nail loading operation, there can occur a nail reversal phenomenon in which the nail N is inclined within the magazine 31 and the head of the nail N is caused to face downwardly within the injection port 32 of the nose part 30.

As shown in FIG. 9, when the loading operation of the connected nails N is executed while the nailing machine is held such that its drive part faces upwardly and its magazine 31 part faces downwardly, in a state where the driving of the nail next to the last nail N is completed, the last nail N is held within the injection port 32 in such a state as it is supplied into the injection port 32 by the pusher 34; however, in case where the pusher 34 is moved backward in the rear end direction of the magazine 31 for the loading operation of new connected nails N, since the pressing and holding force of the nail N by the pusher 34 is removed, the diameter-increased head portion N1 of the nail N is not be able to move into the magazine 31, but the leading end N2 side of the shaft part can move into the magazine 31 and thus the nail N can be rotated about the nail head portion N1 to thereby incline the shaft portion of the nail.

From this state, in case where the nailing machine is turned sideways in order to load new connected nails N into the magazine 31, the leading end side of the nose part 30 is caused to face downwardly. Due to this, the head portion N1 of the nail N is moved within the injection port 32 in the leading end direction thereof, a connecting band N3 sticking to the shaft portion of the nail N and remaining within the magazine 31 is caught on a guide wall 31*a* formed in the magazine 31 for the nail shaft, and thus the nail shaft portion is rotated about its connecting band 3 portion to thereby incline the nail N in such a manner that the nail head portion N1 is positioned downwardly of the nail leading end portion N2. In this state, in case where new connected nails N are loaded into the rear portion of the magazine 31 and are pressed toward the injection port 32 by the pusher 34, the leading end portion N2 of the inclined nail N is rotated upwardly, so that, as shown in FIG. 10, the top nail N is reversed within the injection port 32 of the nose part 30.

In a state where the nail is reversed in the injection port 32, when the driver is driven to thereby drive the nails, the leading end portion of the reversed nail is caught by and between the driver and the inner wall surface of the injection port, so that the nail is clogged; and, the clogged nail can damage the driver or destroy the nose part.

SUMMARY OF THE INVENTION

The invention aims at eliminating the drawbacks found in the above-mentioned conventional nailing machine. Accordingly, it is an object of the invention to provide a nailing machine with a nail inclining preventive mechanism which, even when new connected nails are loaded in a state where one nail is left within the magazine, can prevent the nail from being reversed within the injection port of the nose part and thus can prevent the clogged nail as well as the damaged driver and nose part.

In attaining the above object, according to the invention, there is provided a nailing machine with a nail inclining preventive mechanism, comprising: a nose part including an injection port for guiding a driver to be driven by compressed air in such a manner that the driver can be slid; and, a linear-sheath-shaped magazine disposed continuously with the nose part for storing therein connected nails connected together in a linear manner using a connecting band, wherein the connected nails stored in the magazine are supplied into the injection port of the nose part through an opening formed in the nose part, and the nails supplied into the injection port are driven out of the injection port using the driver. The characteristic aspect of the present nailing machine is as follows: that is, a magnet is disposed on a supply guide surface formed along the above-mentioned opening that allows the nail injection port of the nose part and the interior of the magazine to communicate with each other, and the nail shaft left in the injection port is attracted and held by the magnet to thereby be able to prevent the leading end side portion of the nail shaft of the nail from entering into the magazine.

DESCRIPTION OF THE PREFERRED EMBODIMENT

Figure 1:
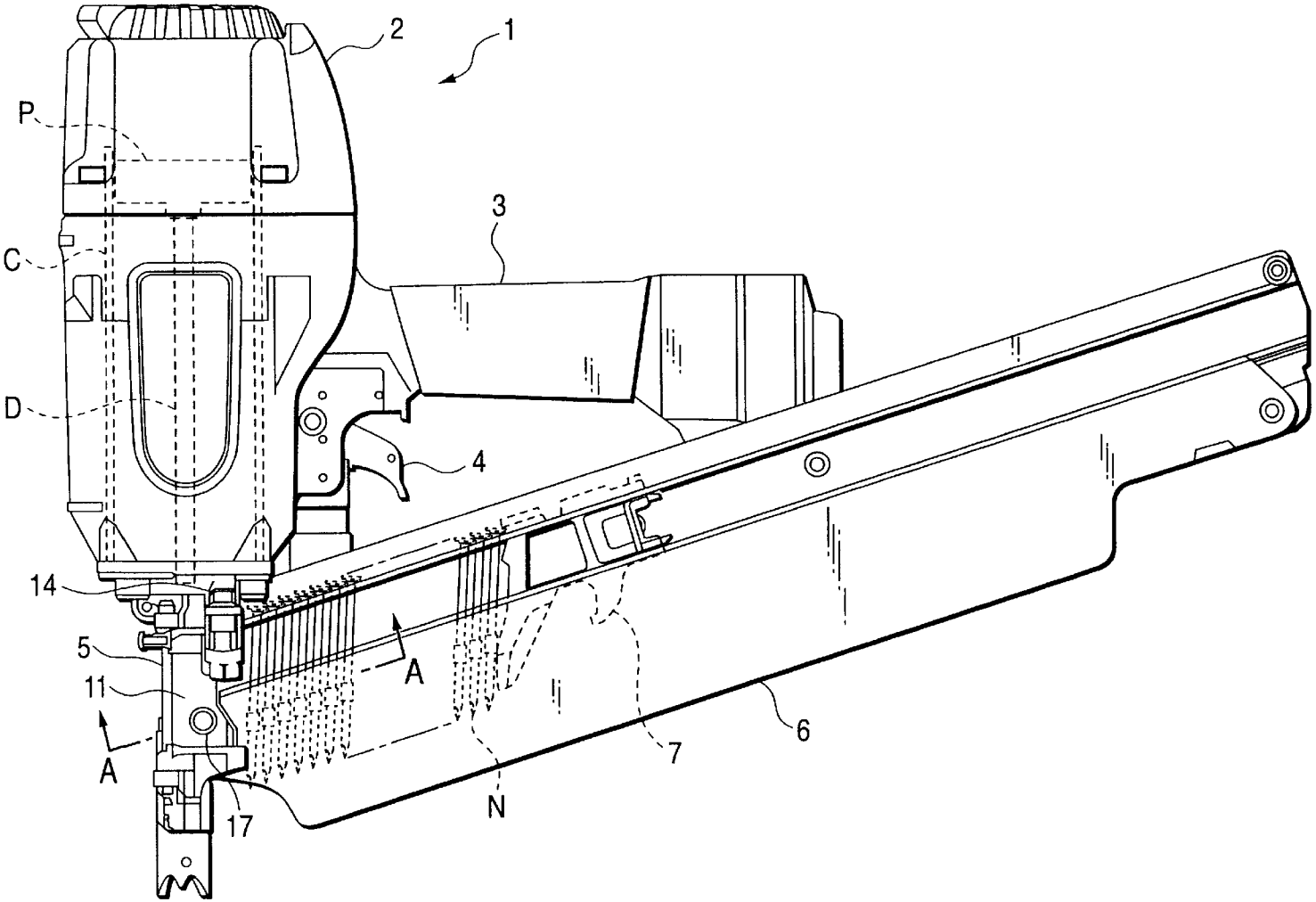
FIG. 1 is a side view of a nailing machine according to a first embodiment of the invention.

Now, description will be given below of the mode for carrying out the invention with reference to the preferred embodiments of the invention shown in the accompanying drawings. FIG. 1 is a side view of a nailing machine according to the invention for use in a nailing machine. The nailing machine 1 comprises a body 2 and a drive part which is stored in the body 2; and, the drive part is composed of a piston P and a cylinder C in which the piston P is stored. In this nailing machine 1, compressed air supplied from a compressed air supply source is introduced into the cylinder C of the drive part to thereby drive the piston P, so that a nail can be driven by a driver D which is connected to the lower surface of the piston P. The compressed air is stored in an air chamber formed within a grip part 3 disposed in the rear of the body 2 and can be introduced into the cylinder C by operating a trigger mechanism 4 disposed in the base portion of the grip part 3. To the lower surface of the body 2, there is connected a nose part 5 having an injection port for guiding the driver D in such a manner that the driver D can be slid. When the piston P is driven, the driver D is driven and moved through the interior of the injection port to thereby drive a nail disposed in the injection port in the leading end direction of the injection port.

Figure 2:
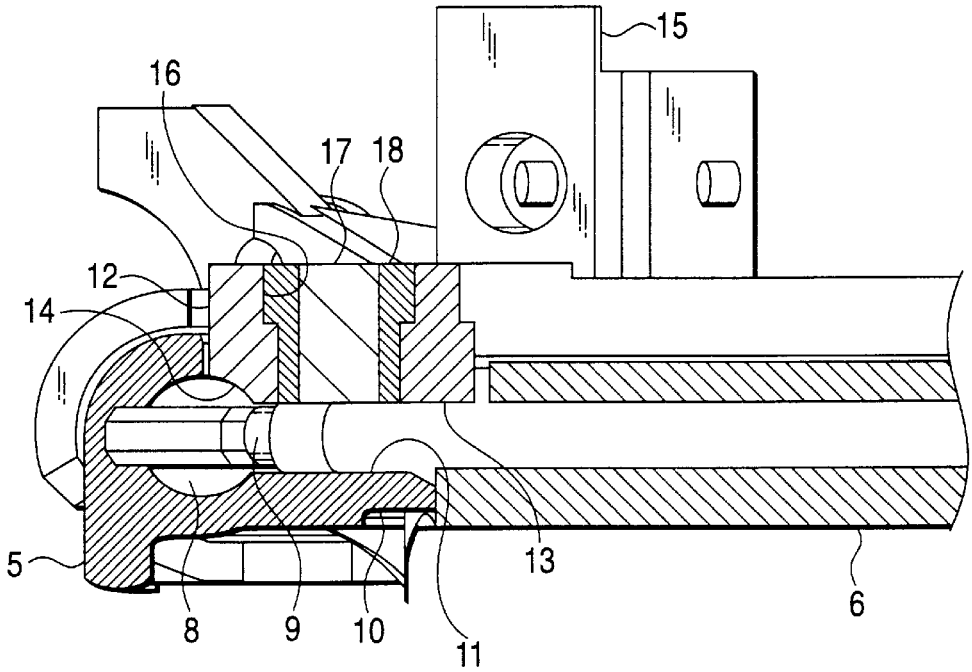
FIG. 2 is a section view taken along the line A—A shown in FIG. 1.

To the nose part 5, there is continuously connected a linear-sheath-shaped magazine 6 for storing therein connected nails N composed of a large number of nails the shaft portions of which are connected together in a parallel manner by a connecting band made of plastic material or paper material; and, within the magazine 6, there is disposed a pusher 7 which is energized by a spring in the direction of the nose part 5. The connected nails N are pushed by the pusher 7 in the direction of the nose part 5 to thereby supply the top nail N of the connected nails N into the injection port of the nose part 5. As shown in FIG. 2, in the nose part 5, there is formed a hollow injection port 8 which is used to guide the driver D in a slidable manner and, in the rear of the injection port 8, there is formed an opening 9 which is used to introduce the connected nails N stored in the magazine 6 into the injection port 8. A fixed guide 10 is disposed in such a manner that it is continuously connected to one side surface of the opening 9 and extends backwardly from the present opening 9 side surface; and, the inner surface of the fixed guide 10 forms a supply guide surface 11 which is used to guide the connected nails N from the magazine 6 into the injection port 8. On the opposing side to the fixed guide 10, there is disposed a door member 12 which is pivotally supported on the nose part 5 in the vicinity of the injection port 8 and can be opened and closed; that is, the door member 12 is disposed such that it is opposed to the fixed guide 10 with a given clearance between them. The front end portion of the magazine 5 is butted against the fixed guide 10 and the backward end face of the door member 12, whereby the connected nails N stored within the magazine 5 can be guided between the fixed guide 10 and door member 12 and can be supplied from the opening 9 into the injection port 8.

Figure 3:
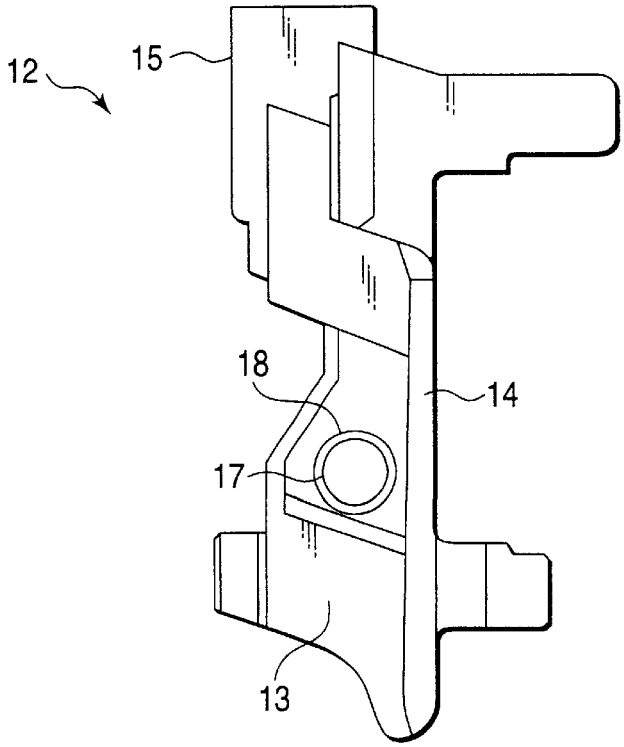
FIG. 3 is a side view of a door member employed in the same nailing machine as shown in FIG. 1.
Figure 4:
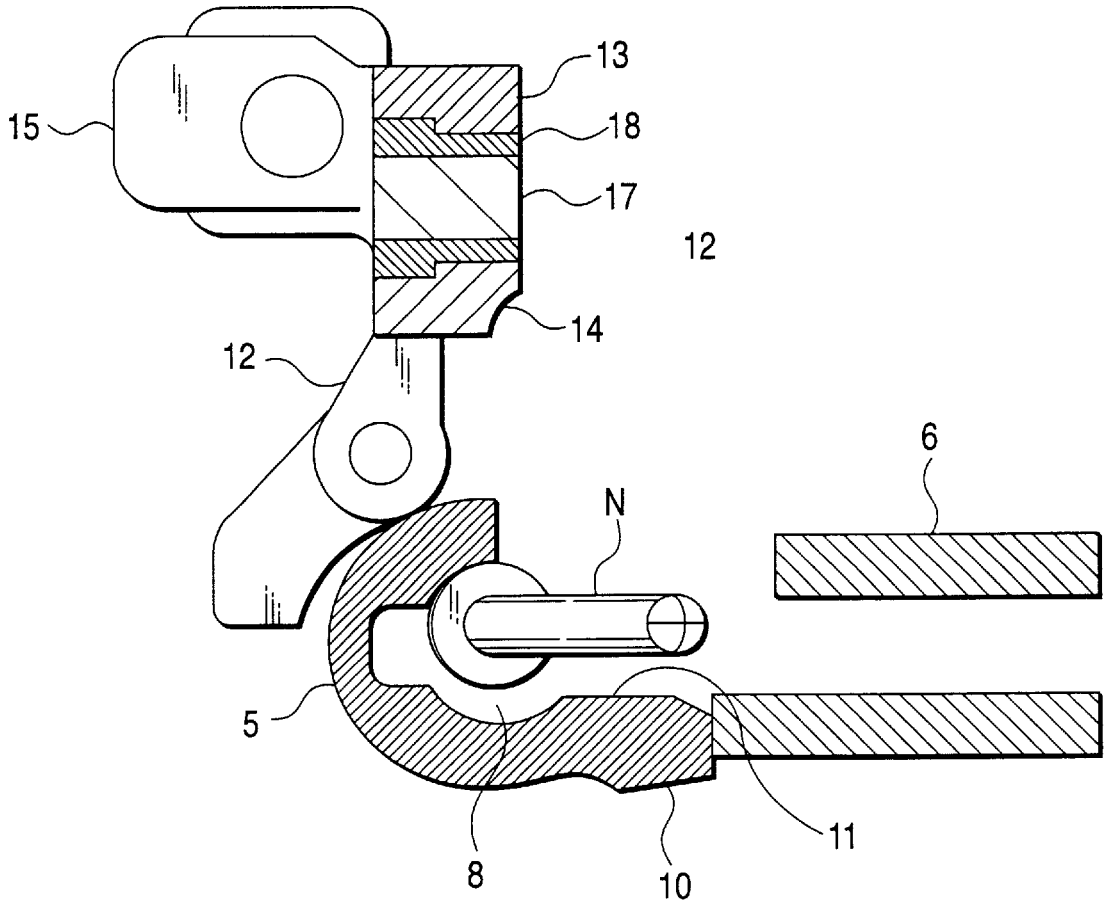
FIG. 4 is a partially sectional plan view of the door member, showing a state thereof in which it is opened.

As shown in FIGS. 3 and 4, the door member 12 is supported in such a manner that it can be rotated with respect to the nose part 5; and, the door member 12 includes a supply guide surface 13 which is used to guide the nails from the magazine 6 into the injection port 8, and an injection guide surface 14 which is formed so as to be continuous with the supply guide surface 13 and forms a portion of the injection port 8. In a state where the door member 12 is closed, the injection guide surface 14 defines the injection port 8 and the supply guide surface 13 forms a guide surface for guiding the nails from the magazine 6 into the injection port 8. In case where the door member 12 is closed, the door member 12 is fixed with respect to the nose part 5 by a latch mechanism 15 formed in the door member 12. When there occurs a nail clogging phenomenon with in the injection port 8 of the nose part 5, the latch mechanism 15 is removed and, after then, the door member 12 is rotated in such a manner as shown in FIG. 4, thereby opening a portion of the injection port 8 and the supply guide surface 13. This can facilitate the operation to remove the nail that is clogged in the injection port 8.

As shown in FIGS. 1 to 4, in the supply guide surface 13 formed by the door member 12, there is formed a through hole 16 which penetrates from the supply guide surface 13 of the door member 12 to the back surface side thereof; and, in the through hole 16, there is buried a magnet 17 which is exposed to the supply guide surface 13 of the door member 12 in such a manner that it is flush with the supply guide surface 13. Since the nose part 5 is generally made of magnetic material belonging to iron, the magnet 17 is stored in a cylinder body 18 formed of non-magnetic material such as brass or plastic material and is fixed to the interior of the through hole 16 by pressure insertion or by adhesion. The magnet 17 is disposed such that it is opposed to such portion of the nail N as extends from the axial-direction-length central portion of the nail N, which is to be supplied from the magazine 6 into the injection port 8, to the leading end side of the shaft portion of the present nail 8; and, the magnet 17 attracts and holds the leading end N2 side of the shaft portion of the nail N supplied into the injection port 8 to thereby prevent the leading end N2 side of the nail shaft portion from entering into the magazine 6.

Figure 5:
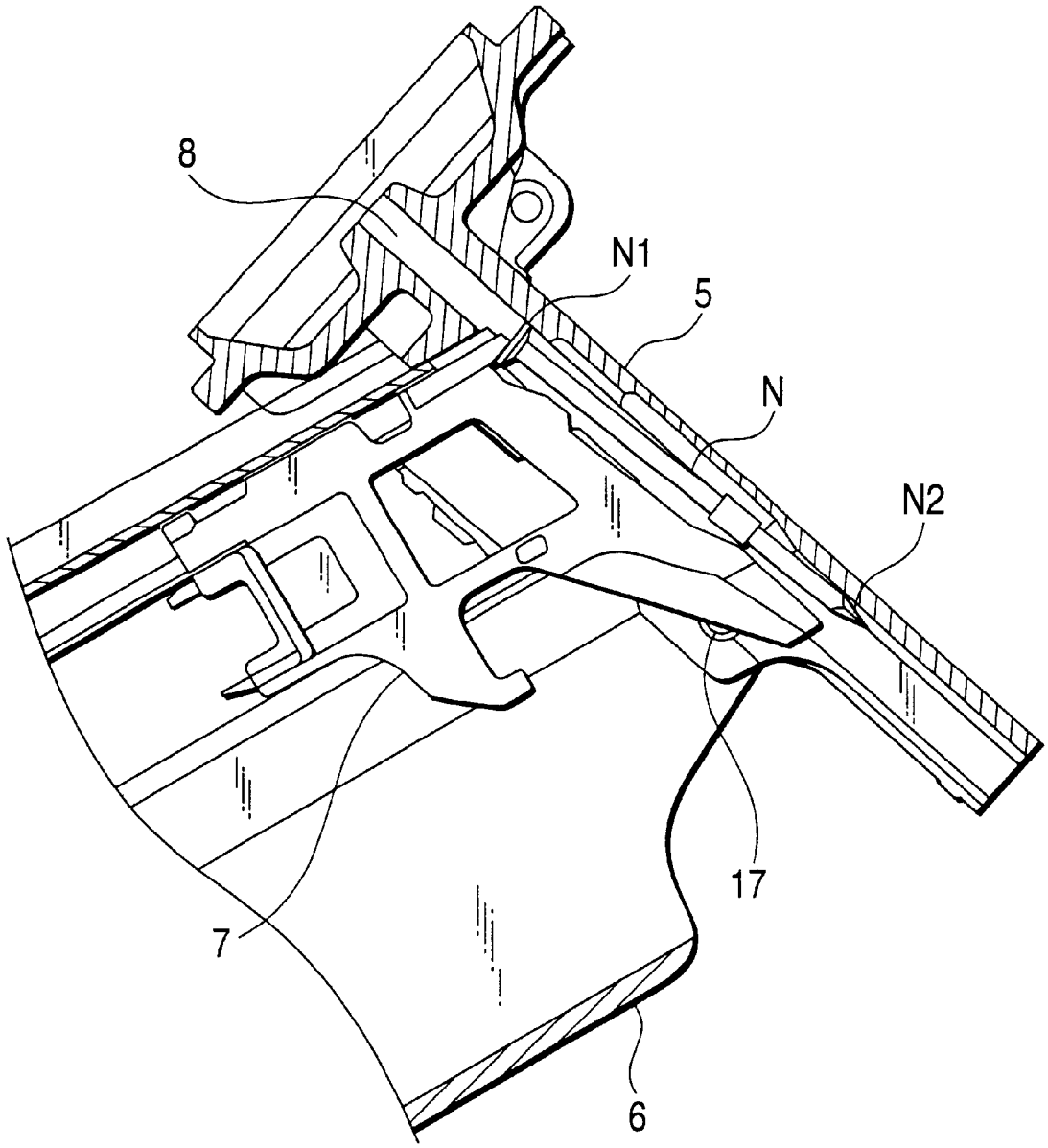
FIG. 5 is a partial section view of the nailing machine shown in FIG. 1, showing a state thereof in which the last nail is left.

Now, description will be given below of a nail loading operation according to the embodiment of the invention with reference to FIGS. 5 to 7. When driving a nail into a vertical wall surface in the horizontal direction, or when driving a nail into a ceiling surface in the upward direction, the nailing operation is executed while holding the nailing machine 1 in such a manner that the rear end portion of the magazine 6 faces downwardly. In a state where driving of the second nail from the rear within the magazine 6 is completed, as shown in FIG. 5, the last nail N remaining within the magazine 6 is pushed and supplied into the injection port 8 of the nose part 5 by the pressing force of the pusher 7 and is held with in the injection port 8 by the pressing force of the pusher 7.

Figure 6:
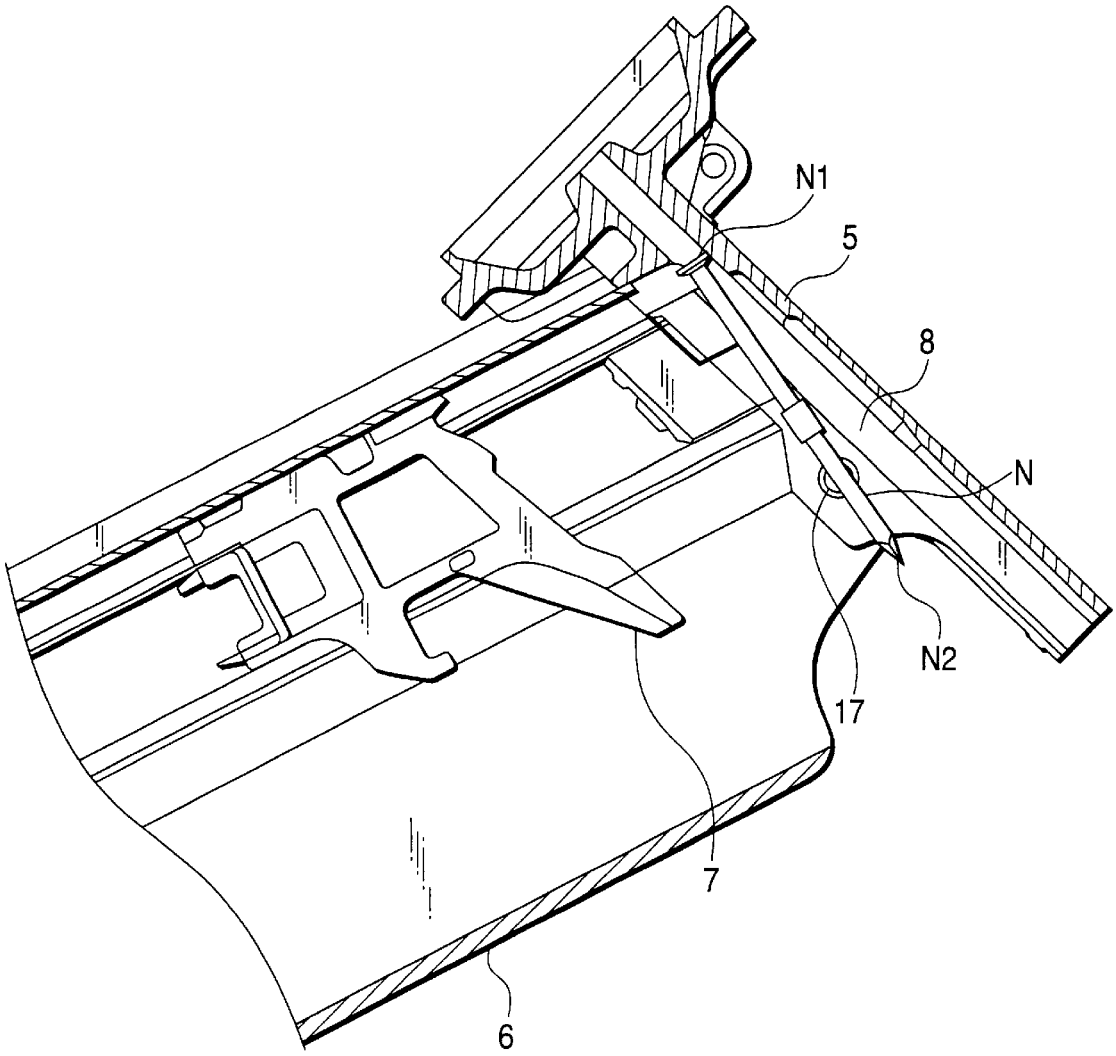
FIG. 6 is a partial section view of the nailing machine, showing a state thereof in which a pusher is moved backwardly from the state shown in FIG. 5.

As shown in FIG. 6, in case where the pusher 7 is slid and moved to the rear side of the magazine 6 in order to load new connected nails N, the increased-diameter head portion N1 side of the nail N supplied into the injection port 8 of the nose part 5 is caught by a portion of the injection port 8 and the leading end N2 side of the shaft portion thereof is rotated due to gravity in a direction where it enters into the magazine 6; but, where the leading end N2 side of the shaft portion of the nail is rotated up to the position at which the magnet 17 is disposed on the supply guide surface 13, the nail shaft portion is attracted and held by the magnet 17 so that the leading end N2 side of the shaft portion of the nail can be prevented from entering into the magazine 6. In other words, while holding the nailing machine 1 in any attitude, the nail shaft can be prevented from inclining more than the angle that is shown in FIG. 6.

Figure 7:
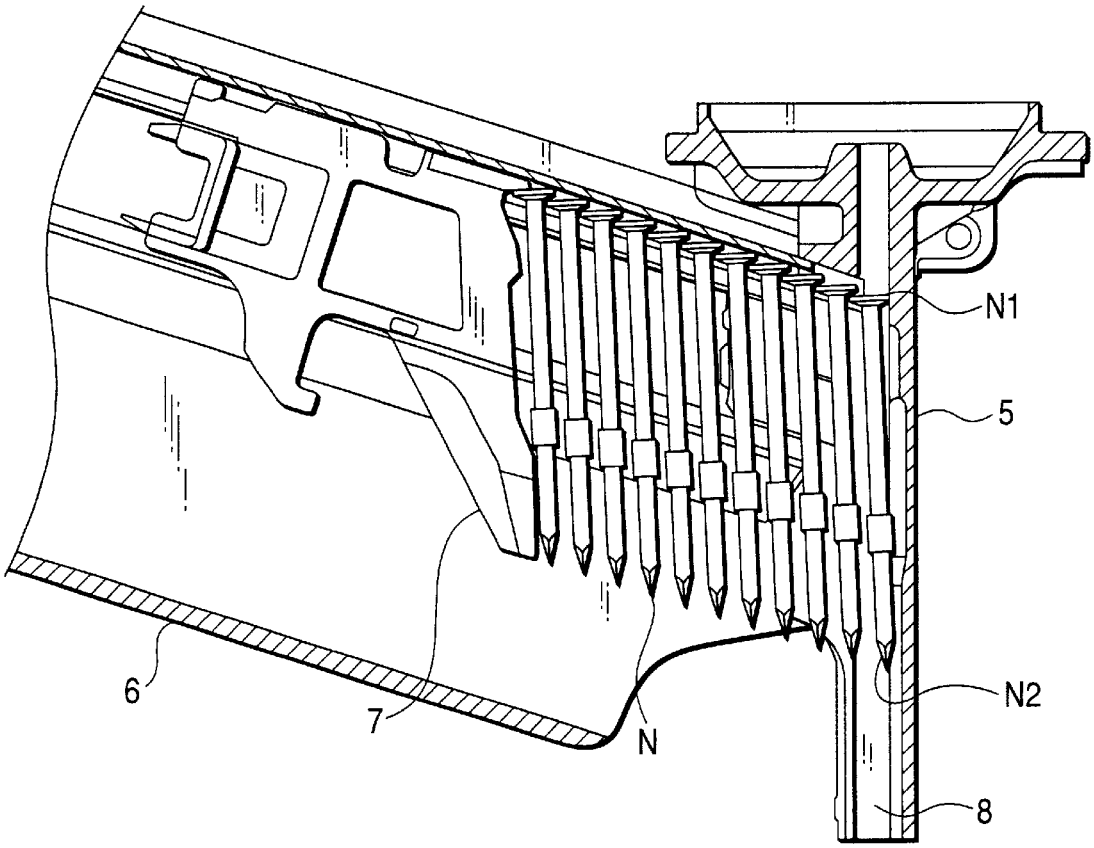
FIG. 7 is a partial section view of the nailing machine, showing a state thereof in which connected nails have been loaded and driving of the connected nails is prepared.

In case where the pusher 7 moved to the rear portion of the magazine 6 is secured by the rear portion of the magazine 6, the secured state of the pusher 7 is removed after new connected nails N are loaded into the rear portion of the magazine 6, and the pressing force of the pusher 7 is applied to the thus-loaded connected nails N from the rear end portion thereof, as shown in FIG. 7, the loaded connected nails N are moved in the direction of the nose part 5 and the top nail of the connected nails N is contacted with the nail N left in the magazine 6 to thereby push the nail N into the injection port 8. In this case, the inclination of the nail N, which has been slightly inclined, is corrected and thus the nail N can be disposed in the injection port 8 in a proper attitude. In this state, in case where the nailing machine 1 is driven, the driver D drives the head portion N1 of the nail N to thereby drive the nail N out of the injection port 8.

In the above-mentioned embodiment, there is shown a nailing machine structured such that one of the supply guide surfaces for guiding the nail N from the magazine 6 into the injection port 8 is formed as the door member 12; and, in this nailing machine, the magnet 17 is mounted on the supply surface 13 formed in the door member 12. However, the magnet 17 may also be mounted on the supply guide surface 11 of the fixed guide 10 that is disposed opposed to the door member 12. Also, the invention can also be enforced in a nailing machine in which the openable and closable door member 12 is not disposed but the supply guide surfaces 11 to be formed by the fixed guide 10 are respectively formed on the two sides of the opening 9 of the nose part 5. In this case as well, the magnet 17 may be mounted on either of the supply guide surfaces 11 of the fixed guide 10. Further, the portion on which the magnet 17 is mounted is not limited to the supply guide surface but the magnet 17 may also be mounted in such a manner that it faces the interior of the injection port 8 formed so as to correspond to the leading end N2 side of the nail shaft portion. At any rate, the necessary and sufficient condition of the structure of the invention is that the magnet 17 can attract and hold the leading end side of the shaft portion of the nail N to thereby prevent the leading end N2 side of the nail shaft portion from entering in the direction of the interior of the magazine 6 and thus prevent the nail shaft from inclining.

Figure 8:
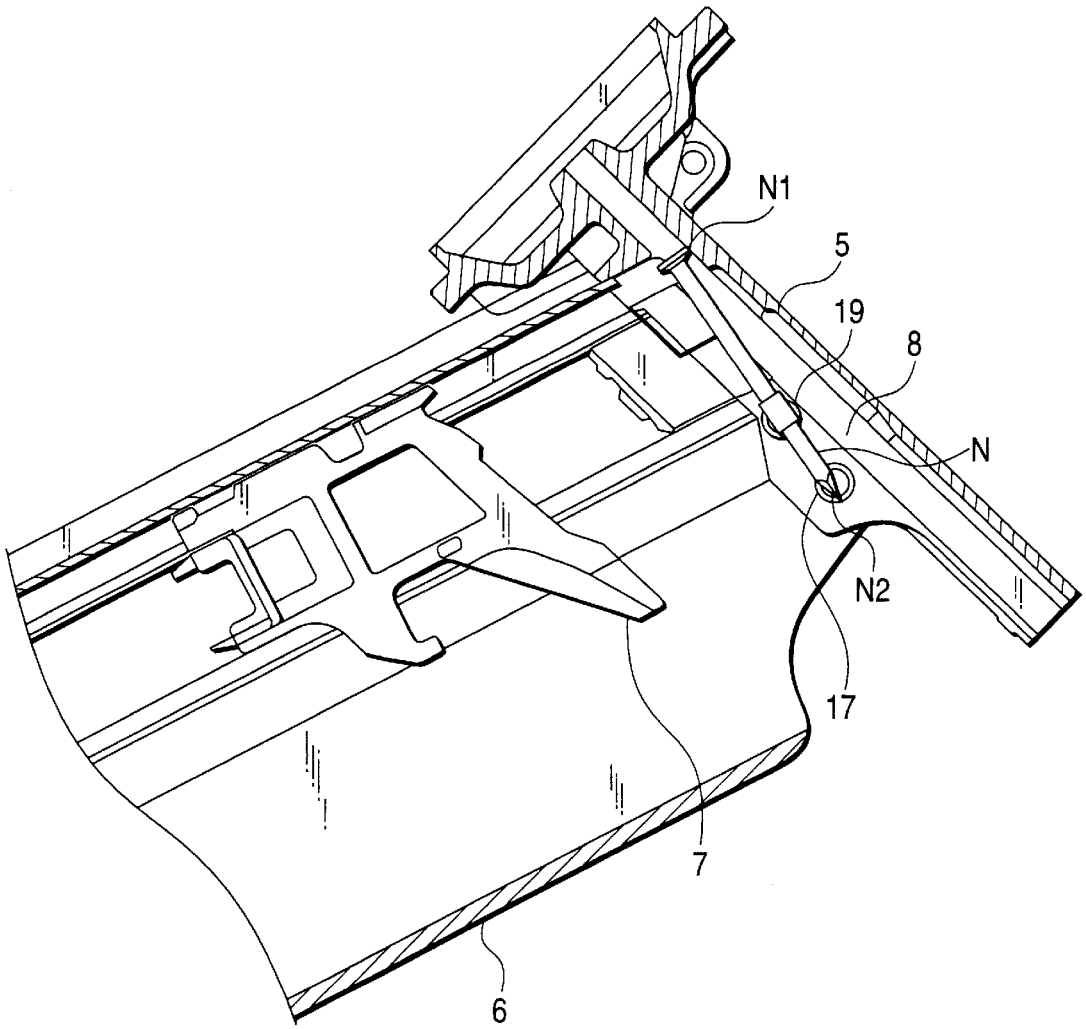
FIG. 8 is a partial section view of the nailing machine, showing a state thereof similar to FIG. 6 in which a second embodiment of a nailing machine according to the invention is used.
Figure 9:
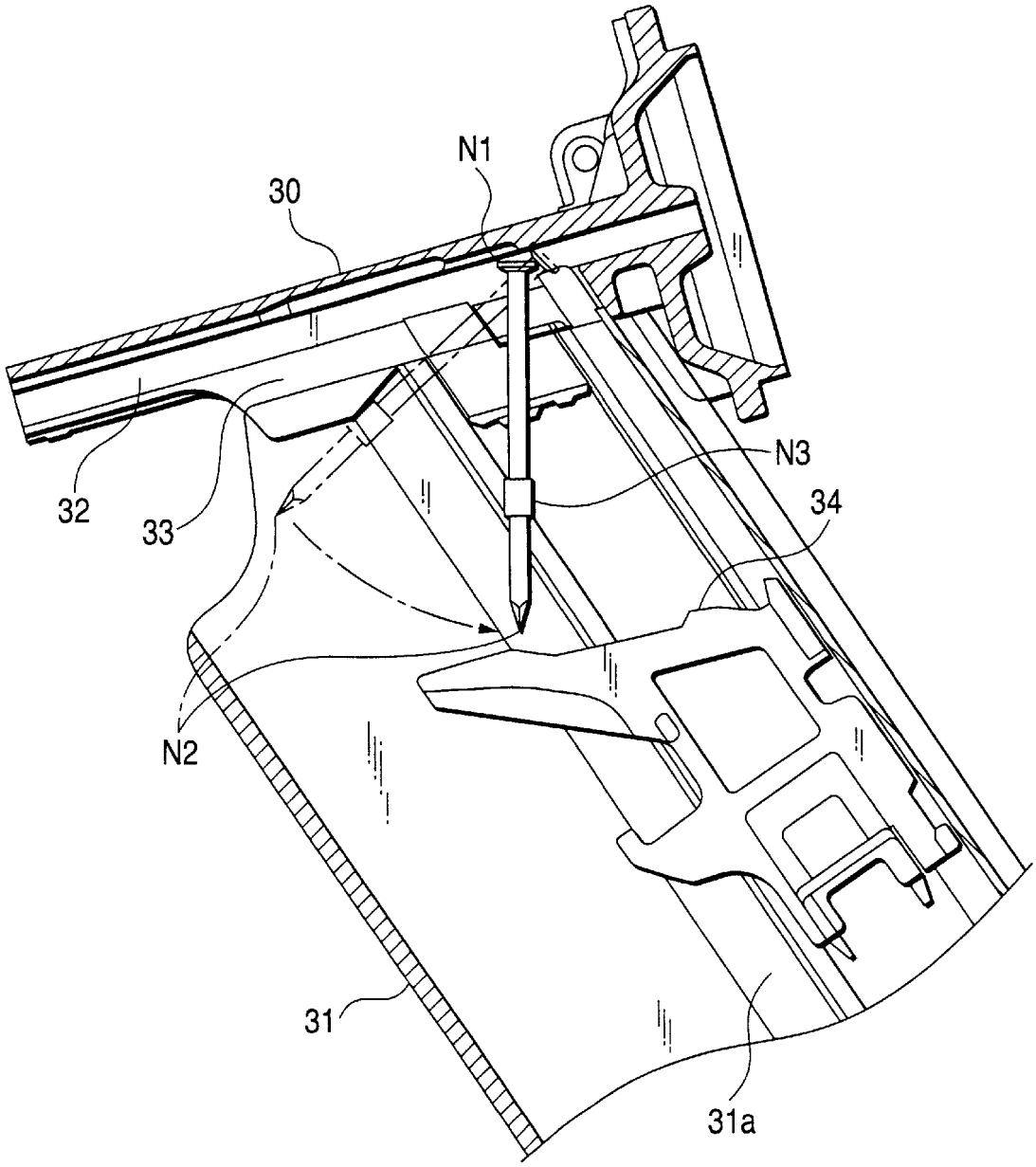
FIG. 9 is a section view of a conventional nailing machine, showing a state thereof in which a nail loading operation is being executed; and, FIG. 10 is a partial section view of the conventional nailing machine, showing a state thereof similar to FIG. 8 in which the last remaining nail is reversed.
Figure 10:
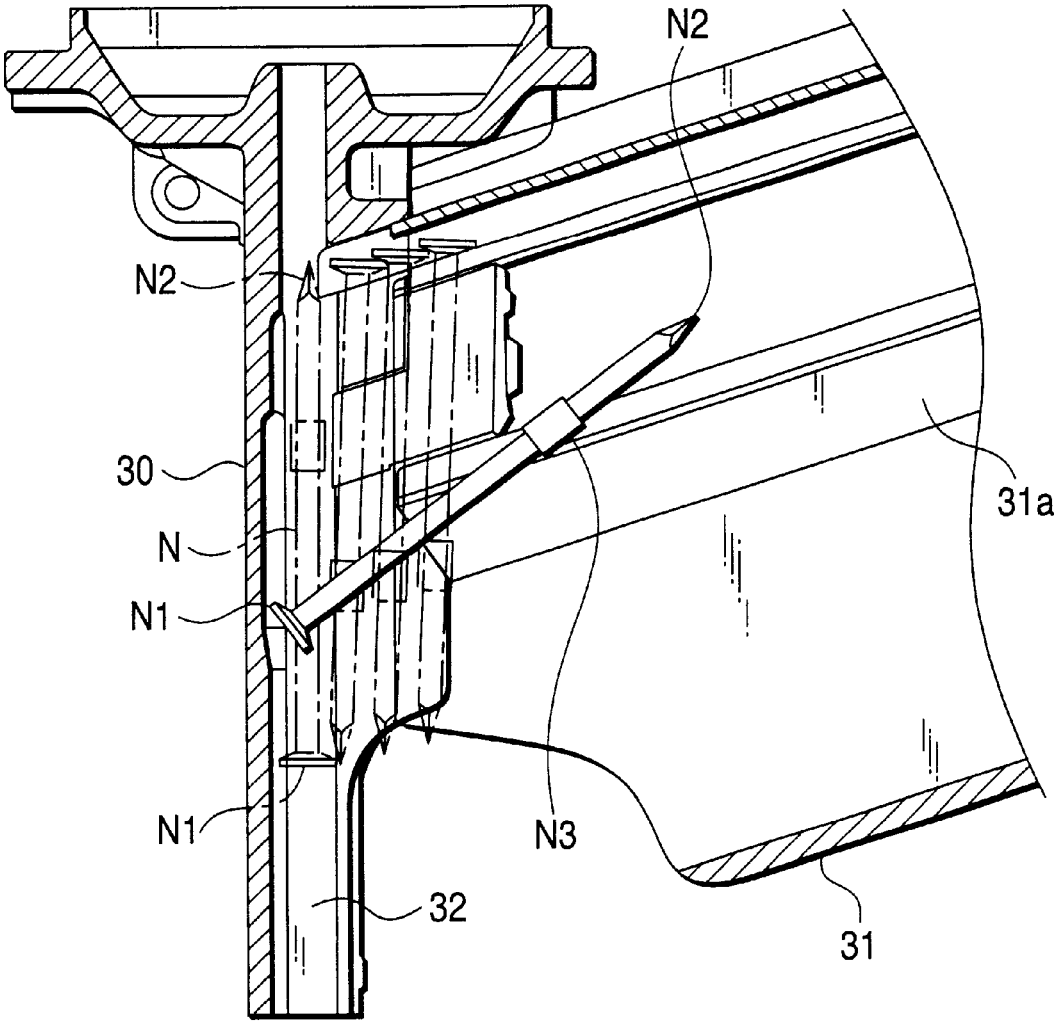

Now, referring to a second embodiment shown in FIG. 8, two magnets 17, 19 are disposed along the longitudinal direction of the shaft portion of a nail. According to the present structure in which plural magnets 17, 19 are disposed on the supply guide surface 13 along the shaft portion of the nail, even when using a small-size nail N formed such that its shaft portion has a short length, the nail N can be attracted and held; and also, the shaft portion of a large-size nail having a long shaft length can be attracted and held by the two magnets and, therefore, it is possible to prevent the leading end N2 side of the shaft portion of the nail from entering into the magazine 6 as well as from inclining.

As has been described heretofore, according to the nailing machine with nail inclining preventive mechanism of the invention, since there is disposed the magnet 17 for attracting and holding the shaft portion of the leading end N2 side of the shaft portion of a nail supplied into the injection port to thereby prevent the leading end side of the shaft portion of the nail from entering into the magazine, even in case where the pusher 7 is moved to the rear side of the magazine for loading of new connected nails, the inclination of the shaft portion of the nail N, which is caused when the shaft portion of the nail N left within the magazine 6 enters into the magazine 6, can be prevented. This makes it possible to prevent only one nail left within the magazine 6 from being reversed and disposed within the injection port in the new-connected-nails loading operation, which in turn can prevent the remaining nail from being clogged in the injection port and also prevent the driver and nose part from being damaged due to the clogged nail.

What is claimed is:

1. A nailing machine comprising:

a nose part including an injection port for guiding a driver to be slidably driven by compressed air;

a linear-sheath-shaped magazine disposed continuously with the nose part for storing therein connected nails connected together in a linear manner using a connecting band; wherein the connected nails stored in the magazine are supplied into the injection port of the nose part through an opening formed in the nose part, and the nails supplied into the injection port are driven out of the injection port using the driver, and a nail inclining preventive mechanism that prevents a leading end of the nail shaft from re-entering into the magazine after the nail has been supplied into the injection port;

wherein the nail inclining preventive mechanism comprises a magnet disposed at the leading end of the nail shaft, the magnet disposed on a supply guide surface formed along the opening, the opening allowing the nail injection port of the nose part and the interior of the magazine to communicate with each other.

2. The nailing machine according to claim 1, wherein the magnet is stored in a cylinder body formed of non-magnetic material, the cylinder body being fixed by one of pressure insertion and adhesion to the interior of a through hole formed in the supply guide surface.

3. A nailing machine comprising:

a nose part having an injection port and an opening;

a magazine storing connected nails to be supplied into the injection port through the opening; and a nail incline prevention mechanism that prevents a leading end of a nail shaft from re-entering the magazine after the nail has been supplied into the injection port;

wherein the nail incline prevention mechanism includes a magnet disposed proximate the nose part and at a leading end of the nail shaft.

4. The nailing machine of claim 3, wherein the nail incline prevention mechanism comprises a plurality of magnets.

5. The nailing machine of claim 3, further comprising a door member, the door member being pivotally supported on the nose part, the magnet being disposed on the door member.

6. The nailing machine of claim 5, wherein the nail incline prevention mechanism comprises a plurality of magnets.

7. The nailing machine of claim 3, further comprising a supply guide surface formed along the opening, the magnet being disposed on the supply guide surface.

8. The nailing machine of claim 7, wherein the nail incline prevention mechanism comprises a plurality of magnets.

* * * * *